US006579610B1

(12) United States Patent
Shortland et al.

(10) Patent No.: US 6,579,610 B1
(45) Date of Patent: Jun. 17, 2003

(54) NON STAIN FLOORING

(75) Inventors: Adrian John Shortland, Northfield (GB); Karen Alexandra Masters, Baldock (GB)

(73) Assignee: Altro Limited, Hertfordshire (GB)

( * ) Notice: Subject to any disclaimer, the term of this patent is extended or adjusted under 35 U.S.C. 154(b) by 0 days.

(21) Appl. No.: 09/830,041

(22) PCT Filed: Jan. 11, 2000

(86) PCT No.: PCT/GB00/00056

§ 371 (c)(1),
(2), (4) Date: Jun. 1, 2001

(87) PCT Pub. No.: WO00/42274

PCT Pub. Date: Jul. 20, 2000

(30) Foreign Application Priority Data

Jan. 13, 1999 (GB) ..... 9900577

(51) Int. Cl.[7] ..... E04B 5/00

(52) U.S. Cl. ..... 428/323; 428/421; 428/422; 427/427; 427/180; 427/453; 52/177; 52/181

(58) Field of Search ..... 52/177, 181; 428/292.1, 428/323, 421, 422, 329, 331, 297.4, 299.4, 522; 427/427, 180, 453

(56) References Cited

U.S. PATENT DOCUMENTS

| | | | | |
|---|---|---|---|---|
| 2,010,025 | A | 8/1935 | Kirchner et al. | |
| 2,793,136 | A | 5/1957 | Root et al. | 117/33 |
| 3,030,251 | A | 4/1962 | Bore et al. | 154/53.5 |
| 3,267,187 | A | 8/1966 | Slosberg et al. | 264/122 |
| 3,310,619 | A | 3/1967 | Slosberg et al. | 264/77 |
| 3,585,099 | A | 6/1971 | Buskirk | 161/63 |
| 4,196,243 | A | 4/1980 | Sachs et al. | 428/147 |
| 4,239,797 | A | 12/1980 | Sachs | 428/327 |
| 4,243,696 | A | 1/1981 | Toth | |
| 4,348,447 | A | 9/1982 | Miller, Jr. et al. | 428/149 |
| 4,405,657 | A | 9/1983 | Miller, Jr. et al. | 427/54.1 |
| 4,501,783 | A | 2/1985 | Hiragami et al. | 428/147 |
| 4,528,231 | A | 7/1985 | Lund | 428/148 |
| 4,882,205 | A | 11/1989 | Valenduc | 427/204 |
| 4,961,980 | A | 10/1990 | Valenduc | 428/67 |
| 4,965,299 | A | 10/1990 | Timm et al. | 523/437 |
| 5,229,460 | A | 7/1993 | Yousuf et al. | 525/198 |
| 5,358,993 | A | 10/1994 | Timm et al. | 524/445 |
| 5,475,951 | A | 12/1995 | Litzow | |
| 5,627,231 | A | 5/1997 | Shalov et al. | 524/523 |
| 5,763,070 | A | 6/1998 | Kerlek et al. | |
| 5,787,655 | A | 8/1998 | Saylor, Jr. | 52/181 |
| 5,830,937 | A | 11/1998 | Shalov et al. | 524/297 |
| 5,965,198 | A * | 10/1999 | Plusquellec et al. | 428/292.1 |
| 2001/0028945 | A1 * | 10/2001 | Chen et al. | 52/177 |

FOREIGN PATENT DOCUMENTS

| | | |
|---|---|---|
| DE | 4120884 | 1/1992 |
| EP | 0217989 | 4/1987 |
| EP | 0494658 | 7/1992 |
| EP | 0552698 | 7/1993 |
| EP | 0703284 | 3/1996 |

OTHER PUBLICATIONS

English–language Abstract for DE 41 20 884.

* cited by examiner

*Primary Examiner*—Carl D. Friedman
*Assistant Examiner*—Nahid Amiri
(74) *Attorney, Agent, or Firm*—Baker Botts LLP

(57) ABSTRACT

A flooring material (1) comprises a base portion (2) having a coating portion (3) which imparts improved stain resistance to the flooring material (1) and is positioned in contact with an upper surface of the base portion (2). The coating portion (3) creates an upper surface of the flooring material (1). A particulate material (6) is embedded in the coating material (3) and at least partially penetrates the base portion (2). The particulate material (6) provides a roughened effect to the upper surface of the flooring material (1) and protects the coating from wear. The coating (3) merges into the base portion (2) where they meet at joint (4) to form a stratified portion (5).

56 Claims, 1 Drawing Sheet

NON STAIN FLOORING

Figure 1:
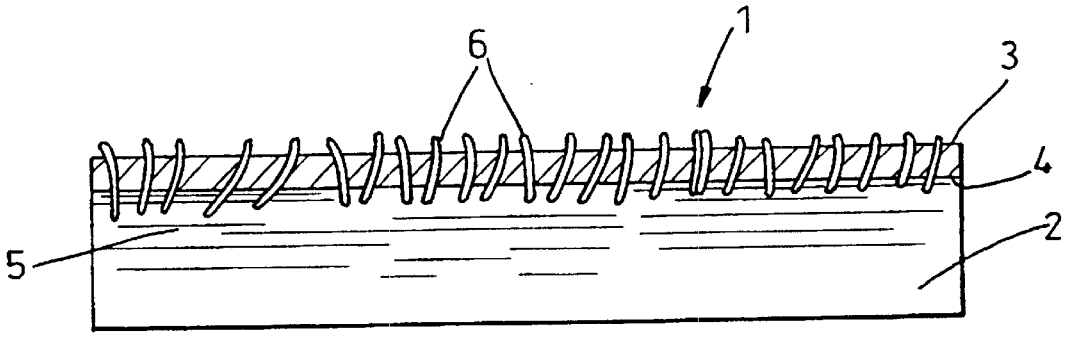

The present invention relates to the treatment of flooring to improve stain resistance and in particular to flooring with enhanced slip resistance and especially PVC flooring with enhanced slip resistance treated to improve stain resistance and to a method of imparting improved stain resistance to flooring, particularly PVC flooring with enhanced slip resistance.

To provide enhanced slip resistance flooring is generally manufactured having a roughened surface which can be created by embossing the surface or by the addition of particulate material to the main component of the flooring during manufacture.

The roughened surface of the flooring increases the risk of dirt being trapped on the surface. The dirt, depending on its nature, can be compatible with components of the flooring resulting in absorption of the dirt into the surface giving rise to a stain.

It is known to apply a coating to a cured floor with enhanced slip resistance to impart increased stain resistance. However, the application of such a coating generally reduces any surface roughness and thus decreases the slip resistance of the floor.

A particulate material can be sprinkled on top of the coating applied to the cured flooring to impart slip resistance. However the coating applied generally thin and adhesion of the particulate material is thus reduced. Such floorings generally lose their non-slip properties quickly as the particulate material becomes dislodged from the coating.

The present invention provides a flooring material comprising a base portion, a coating portion, imparting improved stain resistance to the flooring material, being positioned in contact with an upper surface of the base portion and creating an upper surface of the flooring material and a first particulate material embedded in the coating portion and at least partially penetrating the base portion to provide a roughening effect of the upper surface of the flooring material for enhanced slip resistance and resistance to wear.

We are therefore able to provide a flooring with enhanced slip resistance having improved stain resistance without affecting the effectiveness as the life of non-slip properties which are achieved by the particulate material.

Preferably the flooring material is a plastics flooring material, for example, PVC, modified olefin/olefin copolymer, plasticised acrylic, polyester.

Preferably, the base portion comprises a plastics material such as a PVC plastisol material. The base portion may include a further particulate material dispersed therein. The further particulate material may be aluminium oxide or any other suitable grit. The base portion may contain a pigment. The base portion may include one or more reinforcing supports, the supports are preferably glass fibre reinforced non-woven supports.

The base portion may be made up of one or more layers of plastics material, preferably up to three layers are envisaged.

The coating portion of the flooring material of the present invention provides improved stain resistance to the flooring material.

It is believed that the coating creates a barrier between the upper surface of the flooring material and the base portion thus preventing exposure of the base portion to possible stainants. The coating may further prevent migration of components of the base portion to the upper surface of the flooring material where contact with possible stainants could occur.

The first particulate material being embedded in the coating portion and penetrating the base portion means that the coating portion does not destroy the non-slip properties of the flooring material and the first particulate material is less likely to become dislodged thus prolonging the life of the non-slip properties of the flooring material.

The first particulate material is known as grit can be any one or more of a number of types of hard particles including silicon carbide, silicas (quartz or coloured/natural sands or flints), aluminium oxide and emery.

The use of a further particulate material throughout the base portion further prolongs the non-slip properties of the flooring material during wear.

The base portion of the flooring material may further contain pigmented PVC chips, quartz chips or other decorative additives to add a decorative effect to the flooring material.

The coating portion preferably merges into the base portion to some extent where the portions meet providing an amount of the coating portion in the base portion, this amount of coating portion preferably decreases as the distance from the meeting of the base portion and the coating portion increases.

The merging of the coating portion into the base portion provides some improved stain resistance in the base portion even after the coating portion has been worn away.

The coating portion may comprise any conveniently available thermoplastic material or, alternatively, thermoset material.

The present invention further provides a method of making a flooring material comprising a base portion, a coating portion imparting improved stain resistance to the flooring material and positioned on an upper surface of the base portion and forming an upper surface of the flooring material and a first particulate material embedded in the coating portion and at least partially penetrating the base portion to provide a roughening effect to the upper surface of the flooring material for enhanced slip resistance and protection from wear, the method comprising the steps of:

a) mixing together the components of the base portion;
b) spreading the mixed components of the base portion on a surface;
c) carrying out at least one application of components of the coating portion in powder form to the components of the base portion;
d) carrying out at least one application of a first particulate material to the components of the base portion before or after applying the components of the coating portion in powder form;
e) heating the powder coated base portion to cause the powder coating to form a film.

Preferably the components of the base portion form a paste when mixed.

The paste is preferably spread on the surface at a controlled thickness, preferably a blade is used to spread the paste at a controlled thickness.

When the powder coated paste is heated the powder coating preferably melts and flows to form the film.

If the powder coating is a thermoplastic material the application of heat in step e) simply melts the coating and allows it to flow and form a film.

If the powder coating is a thermosetting material the application of heat in step e) cures the thermosetting material.

The application of heat in step e) may also serve to gel and cure the base portion where the base portion comprises a PVC plastisol material.

Preferably the components of the coating portion are applied to the paste while it is wet. Alternatively the components of the coating portion may be applied to the base portion after it has been cured.

Applying the components of the coating portion as a powder to a wet paste is advantageous as the components of the coating portion can blend into the wet paste to some extent so that some of the components of the coating portion are present in the wet paste, and therefore the base portion of the flooring material, in decreasing amounts as the distance from the surface of the paste, is increased. The effect is a stratified coating which imparts improved stain resistance even when the coating portion has become worn.

However the components of the coating portion can be applied to the base portion after it has been cured. In this case the components of the coating will not blend with the base portion to give a stratified effect but the advantages of the coating present on the surface of the base portion will still be achieved.

Some of the coating portion in powder form can be mixed with the components of the base portion.

The application of the first particulate material to the powder coated wet paste allows the particulate material to be pressed by embossing through the coating into the paste. This is difficult if the base portion has been cured before coating, but it is possible if the base portion has not set completely.

The application of the first particulate material after the components of the coating portion in powder form will reduce the rate of sinkage of the particulate material into the wet paste thus allowing reproducible deposition of first particulate material by mass per unit area.

The components of the base portion preferably comprise a plastics material such as a PVC plastisol. A further particulate material such as aluminium oxide may be included as a component of the base portion. The PVC plastisol may contain a pigment. The base portion may comprise one or more layers of a plastics material.

A dressing of, for example, silicon carbide may be added to the paste spread at a controlled thickness to confer further slip and wear resistance and give some aesthetic properties. A variety of particles or chips such as PVC chip particles or coloured quartz particles may be added to the paste spread at controlled thickness by, for example, sprinkling the particles from above.

The powder coated paste is heated, most preferably in an oven, to melt the powder coating.

The product is preferably cured for 1–10 minutes, most preferably 3 minutes, at 150–220° C., most preferably 190° C.

Preferably the product is embossed. Embossing preferably takes place while the product is still hot and soft after curing and involves the application of pressure preferably by means of a roller.

The components of the coating portion in powder form may be applied by a sprinkle system, a roller pick-up/brush off type system or a spray system.

More than one application of the components of the coating portion in powder form may be necessary.

More than one application of the first particulate material is possible.

The presence of the coating portion is likely to reduce water absorption of the flooring material of the present invention. The presence of the coating portion also reduces the amount of volatile organic compounds given off.

The present invention will now be described by means of example only with reference to the drawings in which:

FIG. 1 shows a cross sectional view of a flooring material of the present invention.

FIG. 1 shows a cross section of a portion of flooring material 1 having a base portion 2 and a coating portion 3 wherein the coating portion 3 merges into the base portion 2 where they meet 4 to form a statified portion 5.

The grit like particulates 6 are embedded in the coating portion 3 and penetrate the base portion 2.

The following examples are illustrative of the present invention:

a plastisol paste typically comprising:

| | Phr (parts per hundred of resin) |
|---|---|
| PVC powder | 100 |
| Plasticiser | 30–70 |
| Mineral filler | 0–100 |
| Thermal stabiliser | 1–3 |
| Pigment | 1–6 |

is produced in a known way. Other additives such as rheology modifiers, biocides, uv stabilisers etc. may also be used. Grits of the appropriate particle size are added at the required level. The paste produced may then be treated in a variety of ways some of which are covered by the following examples:

EXAMPLE 1

Powder is blended with the paste at an addition level of 1% (w/w) and the paste is spread coated at 2 mm by knife over bed on to a non-woven support. Powder is then applied to the surface at the required application rate (50 $gm^{-2}$). Particles of silicon carbide and coloured quartz are each scattered on the surface at the rate of 100 $gm^{-2}$. The paste is then gelled for 3 minutes at 160° C. Further powder at the rate of 50 $gm^{-2}$ is applied and further silicon carbide is applied at the rate of 100 $gm^{-2}$. The product is then fused at 190° C. for 3 minutes and embossed.

In this example the powder is included in and on the surface of the wet paste and a stratified effect is achieved as the powder coating merges with the paste.

EXAMPLE 2

Powder is blended with the paste at an addition level of 1% (w/w). The paste is spread coated at a thickness of 2 mm by knife over roller over bed on to a non-woven support. Particles of silicon carbide and coloured quartz are each scattered on the surface at the rate of 100 $gm^{-2}$. The paste is then gelled for 3 minutes at 170° C. Powder at the rate of 50 $gm^{-2}$ is applied and further silicon carbide is applied at the rate of 100 $gm^{-2}$. The product is then fused at 190° C. for 3 minutes and embossed.

In example 2 the powder is applied over a cured PVC base layer having quartz and silicon carbide and further powder therein prior to application of further silicon carbide. Stratification of the powder throughout the product will not occur due to the powder being applied to the cured base layer.

EXAMPLE 3

Powder is blended with the paste at an addition level of 1% (w/w). The paste is spread coated at a thickness of 2 mm by knife over bed on to a non-woven support. The paste is then gelled for 3 minutes at 160° C. Powder at the rate of 50 $gm^{-2}$ is applied and particles of silicon carbide are applied at the rate of 100 $gm^{-2}$. The product is then fused at 190° C. for 3 minutes and embossed.

In example 3 the powder is applied over a cured PVC base layer having no grits therein prior to application of silicon carbide. Stratification will not be achieved for the reasons set out in Example 2.

EXAMPLE 4

Powder is blended with the paste at an addition level of 1% (w/w) The paste is spread coated at 2 mm by knife over roller on to a non-woven support. Particles of silicon carbide and coloured quartz are each scattered on the surface at the rate of 100 $gm^{-2}$. The paste is then gelled for 3 minutes at 160° C. Powder is applied at the rate of 50 $gm^{-2}$. The product is then fused at 200° C. for 2 minutes and embossed.

In example 4 the powder is applied over a cured PVC base layer having silicon carbide and quartz therein. Again stratification will not be achieved.

EXAMPLE 5

The paste is spread coated at 2 mm by knife over roller on to a non-woven support. Powder is applied at the rate of 50 $gm^{-2}$. Particles of silicon carbide and coloured quartz are each scattered on the surface at a rate of 100 $gm^{-2}$. The product is then fused at 200° C. for 2 minutes and embossed.

In example 5 the powder is applied to a wet PVC paste prior to the application of silicon carbide and quartz and stratification of the powder throughout the product and is likely to occur.

What is claimed is:

1. A flooring material comprising a base portion, a coating portion imparting improved stain resistance to the flooring material being positioned in contact with an upper surface of the base portion and creating an upper surface of the flooring material, and a first particulate material embedded in the coating portion and at least partially penetrating the base portion to provide a roughening effect of the upper surface of the flooring material for enhanced slip resistance and protection from wear.

2. A flooring material according to claim 1 wherein the flooring material is a plastics flooring material.

3. A flooring material according to claim 2 wherein the plastics flooring material is PVC, a modified olefin/olefin copolymer or a plasticised acrylic or polyester polymer.

4. A flooring material according to claim 1 wherein the base portion comprises a PVC plastisol material.

5. A flooring material according to claim 1 wherein the base portion includes a further particulate material dispersed therein.

6. A flooring material according to claim 5 wherein the further particulate material is aluminium oxide.

7. A flooring material according to claim 1 wherein the base portion contains a pigment.

8. A flooring material according to claim 1 wherein the base portion includes one or more reinforcing supports.

9. A flooring material according to claim 8 wherein the supports are glass fibre reinforced non-woven supports.

10. A flooring material according to claim 1 wherein the base portion is made up of one or more layers of plastics material.

11. A flooring material according to claim 10 wherein the base portion comprises up to three layers of plastics materials.

12. A flooring material according to claim 11 wherein the first particulate material is any one or more of a number of types of hard particles.

13. A flooring material according to claim 11 wherein the base portion of the flooring material contains pigmented PVC chips, quartz chips or other decorative additives to add a decorative effect to the flooring material.

14. A flooring material according to claim 11 wherein the coating portion merges into the base portion where the portions meet providing an amount of the coating portion in the base portion.

15. A flooring material according to claim 14 wherein the amount of coating portion merged into the base portion decreases as the distance from the meeting of the base portion and the coating portion increases.

16. A flooring material according to claim 1 wherein the coating portion comprises any conveniently available thermoplastic material or thermoset material.

17. A method of making a flooring material comprising a base portion, a coating portion imparting improved stain resistance to the flooring material and positioned on an upper surface of the base portion to form an upper surface of the flooring material and first particulate material embedded in the coating portion and at least partially penetrating the base portion to provide a roughening effect to the upper surface of the flooring material for enhanced slip resistance and protection from wear, the method comprising the steps of:

a) mixing together the components of the base portion;

b) spreading the mixed components of the base portion on a surface;

c) applying at least one first dressing of components of the coating portion in powder form to the components of the base portion to at least partially penetrate the base portion;

d) applying at least one dressing of a first particulate material to the components of the coating portion in powder form;

e) heating the base portion and said at least one first dressing to cause the components of the coating portion in powder form to form a film.

18. A method according to claim 17 wherein the components of the base portion form a paste when mixed.

19. A method according to claim 18 wherein the paste is spread on the surface at a controlled thickness.

20. A method according to claim 19 wherein a blade is used to spread the paste at a controlled thickness.

21. A method according to claim 17 wherein when the base portion is heated the components of the coating portion in powder form melt and flow to form the film.

22. A method according to claim 17 wherein the components of the coating portion are applied to the paste while it is wet.

23. A method according to claim 17 further comprising gelling or curing the base portion before applying the components of the coating portion.

24. A method according to claim 17 wherein some of the coating portion in powder form is mixed with the components of the base portion.

25. A method according to claim 17 wherein a dressing of silicon carbide, silicas, aluminium oxide, emery or flint is added to the paste spread at a controlled thickness to confer further slip and wear resistance and give some aesthetic properties.

26. A method according to claim 17 wherein the product is cured for 1–10 minutes at 150–220° C.

27. A method according to claim 17 wherein the flooring material is embossed.

28. A method according to claim 17 wherein the components of the coating portion in powder form are applied by a sprinkle system, a roller pick-up/brush off type system or a spray system.

29. A method according to claim 17 wherein more than one application of the components of the coating portion in powder form takes place.

30. A method according to claim 17 wherein more than one application of the first particulate material takes place.

31. A floor covering material comprising a PVC layer and having aggregate embedded in the material for providing surface roughness wherein the material incorporates a barrier layer of polymeric material other than PVC fused into the upper surface of the PVC layer, the aggregate being exposed at the surface of the barrier layer.

32. A material according to claim 31 wherein the barrier layer is of a cured polymeric material.

33. A material according to claim 31 wherein the barrier layer is of a thermoplastic material.

34. A material according to claim 31 wherein the barrier layer is at least as flexible as the underlying PVC layer.

35. A material according to claim 31 wherein the barrier layer is transparent or translucent.

36. A material according to claim 31 wherein the polmeric material of the barrier layer provides enhanced dirt release and/or stain resistance in comparison to the PVC.

37. A material according to claim 31 wherein the barrier layer comprises a polyolefin, (co-)polyester, (co-) polyamide, polyurethane, phenol formaldehyde, epoxy or acrylic polymer or a mixture thereof.

38. A material according to claim 31 wherein the floor covering material has an embossed surface.

39. A material according to claim 31 wherein the aggregate is quartz, corundum, and/or silicon carbide.

40. A method of producing a floor covering material comprising (a) spreading a PVC plastisol on a substrate, (b) distributing over the surface of the plastisol a powder of a film forming, heat fusible polymeric material other than PVC and a particulate aggregate material, and (c) effecting heating to fuse the plastisol and convert the powder into a film, steps (b) and (c) being effected such that aggregate is exposed at the surface of the film.

41. A method according to claim 40 wherein the powder is distributed over the plastisol prior to the aggregate material.

42. A method according to claim 41 wherein the powder applied to the plastisol is softened prior to distribution of the aggregate.

43. A method according to claim 40 wherein the powder is distributed over the plastisol simultaneously with the aggregate.

44. A method according to claim 40 wherein the aggregate is distributed over the plastisol prior to the powder.

45. A method according to claim 44 wherein excess powder is removed from the plastisol prior to step (c).

46. A method according to claim 45 wherein excess powder is removed by suction.

47. A method according to claim 40 wherein the powder is a thermoplastic material.

48. A method according to claim 40 wherein the powder is of a curable resin system.

49. A method according to claim 48 wherein said resin system is cured by heat and curing is effected in step (c).

50. A method according to claim 48 wherein the resin system is curable by UV-radiation.

51. A method according to claim 50 wherein UV curing is effected subsequent to step (c).

52. A method according to claim 50 wherein the powder comprises a polyolefin, (co-)polyester, (co-)polyamide, polyurethane, phenol formaldehyde, epoxy or acrylic polymer or a mixture thereof.

53. A method according to claim 50 wherein embossing is applied subsequent to step (c).

54. A method according to claim 50 wherein the aggregate is quartz, corundum and/or silicon carbide.

55. A method according to claim 50 wherein the powder incorporates at least one of a flow modifying agent, a flame retardant, a biocide, a gloss modifier and a matting agent.

56. A flooring material as specified in claim 12 wherein the hard particles include particles of a material selected from the group comprising silicon carbide, silica, aluminum oxide, emery and flint.

* * * * *